United States Patent [19]

Cuscino et al.

[11] Patent Number: 4,582,027

[45] Date of Patent: Apr. 15, 1986

[54] ECONOMIZER RECIRCULATION FOR LOW-LOAD STABILITY IN HEAT RECOVERY STEAM GENERATOR

[75] Inventors: Richard T. Cuscino, No. Andover; Russell L. Shade, Jr., Boxford, both of Mass.

[73] Assignee: General Electric Company, Lynn, Mass.

[21] Appl. No.: 746,698

[22] Filed: Jun. 20, 1985

[51] Int. Cl.[4] ..... F22D 1/00

[52] U.S. Cl. ..... 122/414; 122/406 R; 122/452; 122/456; 122/477

[58] Field of Search ..... 122/414, 415, 406 R, 122/406 A, 452, 456, 466, 477

[56] References Cited

U.S. PATENT DOCUMENTS

| | | | |
|---|---|---|---|
| 2,594,471 | 4/1952 | Marshall | 122/477 X |
| 2,702,026 | 2/1955 | Dalin | 122/477 X |
| 3,349,755 | 10/1967 | Miller | 122/406 R |
| 4,206,802 | 6/1980 | Reed et al. | 165/1 |

*Primary Examiner*—Edward G. Favors
*Attorney, Agent, or Firm*—James W. Mitchell

[57] ABSTRACT

A recirculation apparatus is employed to recirculate a portion of the feedwater in a vertical-tube economizer to reduce the likelihood of reverse flow and steaming at startup and/or low load. A recirculation valve, opened at low load, directs part of the water from the economizer outlet back to the inlet of the boiler feed pump via a deaerator. The recirculated water not only increases the pumping head across the economizer tube planes, but also reduces the temperature rise of the increased water flow rate passing through the economizer tubes which now enters the economizer tube bank at an elevated temperature. The reduced temperature rise in a given single pass through a tube plane consequently reduces the buoyant force which opposes the pumping head in downflowing tube planes. Additionally, the amount of water being recirculated at these light load conditions results in a total boiler feed pump flow which is well within the capacity of a given pump size without consideration of the present invention. Furthermore, a simple control system could be employed whereby the recirculation valve is opened or closed dependent upon the level of gas turbine loading compared to a predetermined stability threshold load level.

8 Claims, 5 Drawing Figures

ECONOMIZER RECIRCULATION FOR LOW-LOAD STABILITY IN HEAT RECOVERY STEAM GENERATOR

BACKGROUND OF THE INVENTION

The present invention relates to heat recovery steam generators and, more particularly, to economizer sections of heat recovery steam generators.

Heat recovery steam generators are employed to extract sensible heat remaining in the exhaust of a gas turbine to produce an overall system which better utilizes the thermal energy available in the fuel. A typical gas turbine, operating independently, exhibits a thermodynamic efficiency of on the order of 30 percent due to the large amount of heat discharged in its exhaust. The addition of a heat recovery steam generator to harvest the exhaust heat can result in a plant system having an overall thermodynamic efficiency exceeding 70 percent. This increase in efficiency is attained at the price of additional capital investment. Increasing fuel costs are providing economic incentives for taking advantage of the increases in thermodynamic efficiency made available by adding a heat recovery steam generator to a gas turbine.

A heat recovery steam generator typically consists of an evaporator containing an array of tubes past which the gas turbine exhaust gasses are flowed. Water in the tubes is evaporated to produce saturated steam. The saturated steam is circulated through coils of a superheater which are interposed in the exhaust gas flow upstream of the evaporator to receive the hottest gas. The saturated steam is superheated in the superheater before being delivered to a using process such as, for example, a steam turbine. Downstream of the evaporator, the gasses may be flowed past the tubes of an economizer to heat feedwater flowing therethrough. Finally, the gasses leaving the economizer may be fed through a recuperator to heat incoming combustion air and/or through an evaporator of a low-pressure steam generator. Additional elements, not of concern to the present disclosure, may be included such as, for example, auxiliary burners, auxiliary bypass stacks and feedwater deaerators. The problem which the present invention seeks to solve is flow instability and possible early tube failure due to the unwanted generation of steam in the tubes of the economizer.

Two general types of heat recovery steam generators are differentiated by the manner in which water and steam circulation is achieved in the evaporator. The two types are known as forced circulation and natural circulation heat recovery steam generators.

In a forced circulation heat recovery steam generator, one or more pumps are employed to force water and steam through generally horizontal tubes in the evaporator. The steam and water mixture, is circulated through a steam drum in which the steam and water are separated. The steam is separated from the mixture and sent to the superheater; the water is returned to the evaporator. The configuration of the economizer in a forced circulation heat recovery steam generator is dictated by the configuration of the evaporator and its direction of gas flow. That is, the tubes in the economizer of such a system are conventionally disposed horizontally.

A natural circulation evaporator, in contrast, generally employs vertically oriented tubes past which the exhaust gasses are flowed in the horizontal direction. A steam and water mixture from the evaporator tubes flows upward to a steam drum located above the evaporator tube bank. The steam is separated from the water in the steam drum and is sent to the superheater or using process. The water from the steam drum is returned to the bottom of the evaporator tube bank through downcomer tubes or pipes. The difference between the mean mixture density in the evaporator riser tubes and the mean water density in the downcomer tubes applied over the height of the evaporator tube bank establishes a net gravity head which drives a natural circulation in the evaporator tube bank without the need for pumping to maintain such circulation. Efficient interfacing with constant gas path dimensions generally leads to an economizer which also utilizes vertically oriented tubes.

An economizer with vertical tubes is conventionally fabricated in a plurality of tube planes. Each tube plane includes a parallel array of tubes connected at top and bottom to headers. A tube plane may consist of one or more rows per pass. For example, feedwater is pumped into an upper inlet header and flows downward in parallel through the tubes of the first pass to a second lower header. It then flows upward to the next header and continues in such a serpentine pattern toward the final outlet header. The feedwater gains sensible heat released by the hotter exhaust gas by forced convection heat transfer through finned tubes during each pass until the heated feedwater finally reaches the outlet from which it is connected to the steam drum.

When the feedwater flows upward through an economizer tube plane the buoyancy developed as the feedwater gains heat aids the pumping pressure head between the top and bottom headers of the tube plane. Both pumping pressure head and buoyancy thus aid circulation in upward flowing tube planes. In tube planes in which the feedwater flows downward, the buoyancy no longer aids the pumping pressure head, but instead, the buoyancy opposes the pumping pressure head. Since the tube planes in the economizer are in series, the total end-to-end feedwater flow is determined by the amount of feedwater passing the boiler feed pump which is, in turn, controlled by the amount of steam being demanded by the using process. This does not necessarily imply, however, that all tubes in a tube plane carry the same flow. Since all tubes within a particular tube plane are in parallel, it is possible for one or more tubes to carry substantially less feedwater with the remainder of the tubes carrying slightly more.

At low feedwater flow rates such as encountered, for example, during startup, the total feedwater flow may be so low that flow stagnation reversal and/or steaming may occur in one or more tubes of a tube plane. If steaming should occur in a tube plane having upward flow, the steam and water readily flow upward to maintain a net positive (forward) flow in all of the tubes in the tube plane. The same is not true of the downflowing tube planes. Since the pumping pressure head and the buoyancy compete with each other in tube planes having downward flowing water, the problem of unsteady flow and potential steaming is accentuated in those locations. The buoyancy in one or more tubes in a downflowing tube plane may reduce the flow rate therein sufficiently to increase the residence time of the feedwater to a value which permits steaming to begin. The presence of steam may partially or totally block further flow through the affected tubes or may, in fact, produce reverse flow therein. The net plenum-to-plenum flow remains positive due to increased flow through the remaining tubes of the tube plane.

Even without steaming, a sufficiently low driving pressure head at light loads may result in a multivalued hydraulic characteristic for the tube plane, where reversal to upward flow in one or more tubes of the plane is possible. If the flow reverses direction, sensible heat is still added, and steaming is a likely end result.

If an unsteady steaming condition in one or more tubes in a tube plane remains in existence for a period of time, the affected tube dries out, perhaps periodically, and becomes subject to thermal fatigue.

It is generally known that unstable flow in downflowing economizer tube planes due to steaming in one or more tubes can be a stable condition which, once begun, is able to maintain itself even when feedwater flow is increased well beyond a threshold value which is originally effective to prevent the onset of such unsteady flow. This results from the fact that, once flow stoppage or reverse flow occurs in a downflowing tube, a greater plenum-to-plenum pressure head is required to overcome it than is required to avoid reversal and/or steaming before it occurs.

Some of the known possible solutions to this problem are undesirable because of their negative effect on efficiency. One possible solution, of course, is the elimination of downflowing tube planes. This may be accomplished, for example, by returning the feedwater from the top plenums to the bottom plenums through return lines which are either outside the gas flow or are insulated from it. In this manner, all heating takes place in upward-flowing tubes. This solution requires substantially more tubes to achieve a desired amount of active heat transfer surface and, since it involves conveying the downflowing feedwater outside and then back into the gas path on each pass, it creates a substantial complexity in piping as well as an increase in cost.

Another possible solution includes employing tube inlet orificing to effectively increase the driving pressure head at a given mass velocity. This artificially increases the plenum-to-plenum pumping head across all of the tubes in a tube plane and thereby reduces the tendency for one or more of the tubes to generate steam. The required orifice size could be so small, however, that orifice plugging may be a concern. In addition, the flow restriction imposed by the orifices becomes a problem at high flow rates requiring increased pumping power to overcome it resulting in a potentially substantial performance penalty at high loading conditions during which performance is usually guaranteed. The use of orifices to solve a differential-flow problem in the heat exchanger tube bundle of a moisture separator reheater is disclosed in U.S. Pat. No. 4,206,802, the disclosure of which is herein incorporated by reference.

A further possible solution includes venting the economizer discharge headers of tube planes in which flow reversal or steaming may be a problem to the steam drum. This artificially reduces the discharge header pressure and thus increases the effective pumping head seen by the tube plane. This solution invokes a thermodynamic efficiency penalty as well as increased cost due to piping complexity and additional header and steam drum penetrations. The penalty in efficiency may be reduced or eliminated at high loading conditions above the stability threshold by shutting off the venting circuit, but a somewhat sophisticated control system would be involved.

Some forced circulation systems employ recirculation of heated water to discourage steaming and to reduce cold-end corrosion of the tubes. Such recirculation is driven in response to temperature and/or pressure in the system. None of these known forced-circulation systems, usually employing horizontal tubes, encounter the problems of economizer flow instability and reverse flow which the present invention addresses and solves.

OBJECTS AND SUMMARY OF THE INVENTION

Accordingly, it is an object of the invention to provide a vertical-tube economizer which overcomes the drawbacks of the prior art.

It is a further object of the invention to provide a vertical-tube economizer in which steaming is inhibited in downcoming tubes at low feedwater flow.

It is a still further object of the invention to provide a vertical-tube economizer in which steaming is inhibited by increasing the feedwater flow by recirculation during low feedwater demand.

It is a still further object of the invention to provide a vertical-tube economizer in which unstable flow is eliminated by reducing the buoyant force in downflowing tube planes in concert with increasing the driving force and thereby eliminating a multi-valued hydraulic characteristic for the tube plane.

Briefly stated, a recirculation apparatus is employed to recirculate a portion of the feedwater in a vertical-tube economizer to reduce the likelihood of reverse flow and steaming at startup and/or low load. A recirculation valve, opened at low load, directs part of the water from the economizer outlet back to the inlet of the boiler feed pump via a deaerator. The recirculated water not only increases the pumping head across the economizer tube planes, but also reduces the temperature rise of the increased water flow rate passing through the economizer tubes which now enters the economizer tube bank at an elevated temperature. The reduced temperature rise in a given single pass through a tube plane consequently reduces the buoyant force which opposes the pumping head in downflowing tube planes. Additionally, the amount of water being recirculated at these light load conditions results in a total boiler feed pump flow which is well within the capacity of a given pump size without consideration of the present invention. Furthermore, a simple control system could be employed whereby the recirculation valve is opened or closed dependent upon the level of gas turbine loading compared to a predetermined stability threshold load level.

According to an embodiment of the invention, there is provided an economizer system for heating feedwater in a heat recovery steam generator comprising at least first and second economizer tube planes, each of the economizer tube planes including a plurality of generally parallel tubes, the tubes being generally vertically disposed, each of the economizer tube planes including a top header and a bottom header, all of the plurality of tubes in each economizer tube plane being connected in parallel to their top and bottom headers whereby parallel feedwater flow through the plurality of tubes between the top and bottom headers is enabled, one of the top and bottom headers being an inlet header, a second of the top and bottom headers being an outlet header, a boiler feed pump, the boiler feed pump being effective for applying a flow of feedwater to the inlet header, means for serially interconnecting the economizer tube planes, the means for serially interconnecting including means for flowing the feedwater upward and downward in tubes of alternating ones of the economizer tube planes between the inlet header and the outlet header, means for conveying heated feedwater from the outlet header to a using process and means for recirculating at least a portion of the heated feedwater from the outlet header to an inlet of the boiler feed pump whereby an increased flow is produced through all of the economizer tube planes and a condition permitting initiation of reverse flow in any of the tubes is substantially reduced.

According to a feature of the invention, there is provided a method for reducing reverse flow in vertical tubes of an economizer of a heat recovery steam generator wherein the economizer includes at least first and second substantially vertical economizer tube planes each having a top and bottom header and a plurality of parallel tubes connected between the top and bottom header for permitting parallel feedwater flow therein, the economizer including a boiler feed pump feeding a flow of makeup feedwater to an inlet header of one of the first and second economizer tube planes, comprising serially interconnecting the economizer tube planes for flowing said feedwater upward and downward in tubes of alternating ones of the economizer tube planes between an inlet header and an outlet header, feeding heated feedwater from the outlet header to a using process, recirculating at least a portion of the heated feedwater from the outlet header to an inlet of the boiler feed pump whereby an increased flow is produced through all of the economizer tube planes and a condition permitting initiation of reverse flow in any of the tubes is substantially reduced.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
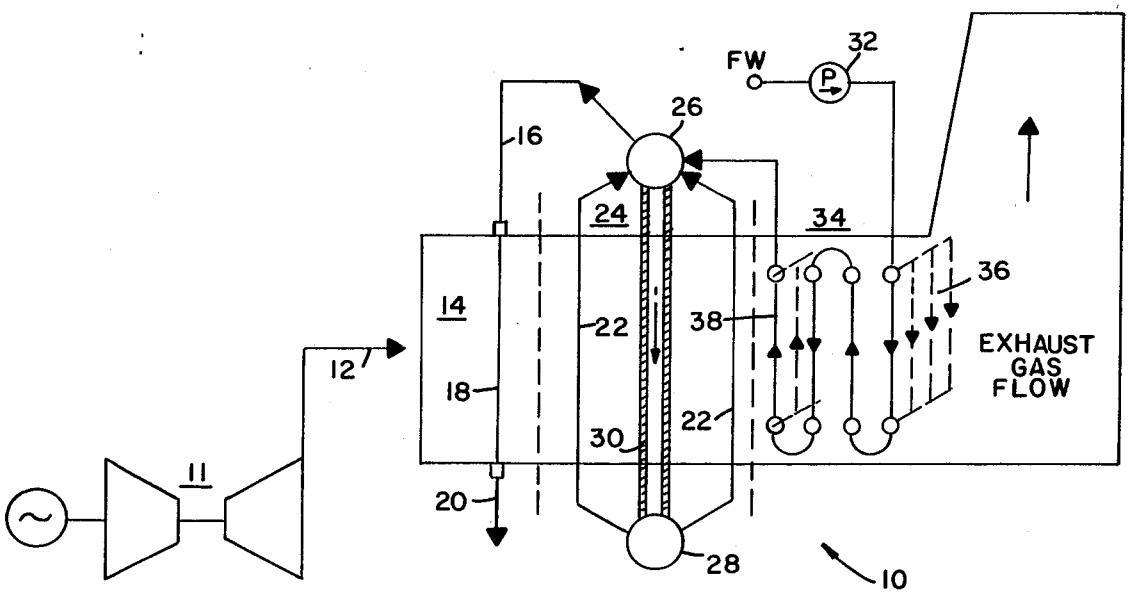
FIG. 1 is a simplified schematic diagram of a heat recovery steam generator according to the prior art.

Referring now to FIG. 1, a simplified schematic diagram of a conventional natural circulation heat recovery steam generator is shown generally at 10. A flow of a heated gas originating, for example, in a gas turbine 11 is applied, as indicated by an arrow 12, to a superheater 14. A flow of saturated steam enters superheater 14 through a steam line 16. The steam flows through a plurality of superheater tubes 18 (only one of which is indicated) during which its temperature is elevated above the saturation temperature to produce superheated steam before exiting on a superheated steam line 20 for delivery to a using process such as, for example, a steam turbine (not shown). The gas exiting superheater 14 flows past a plurality of evaporator tubes 22 in a natural circulation evaporator 24. As discussed in the background section of the present patent application, evaporator tubes 22 in a natural circulation evaporator 24 are disposed generally vertically. A mixture of steam and water generated in evaporator tubes 22 is carried upward into a steam drum 26 wherein the steam is separated from the water before it enters steam line 16. The water from steam drum 26 is returned to a bottom connecting header 28 by one or more insulated downcomers 30 of large diameter. Circulation through evaporator tubes 22 and the return through insulated or unheated downcomer 30, is naturally driven by the difference in density of the steam-water mixture in evaporator tubes 22 and the water in downcomers 30 without the need for forced circulation to maintain the flow on this path.

A boiler feed pump 32 supplies makeup water (FW) to replace the water converted to steam in natural circulation evaporator 24. In order to improve the efficiency of the overall process, the feedwater from boiler feed pump 32 is fed through an economizer 34 wherein it is heated before being fed to natural circulation evaporator 24. The vertical configuration of evaporator tubes 22 in natural circulation evaporator 24 favor the use of vertically oriented tubes in economizer 34. Accordingly, a plurality of tube planes are provided in economizer 34, each of which includes a plurality of parallel, spaced-apart, tubes connected between top and bottom headers. The plurality of tube planes in economizer 34 is represented by a single tube plane 36 receiving feedwater directly from boiler feed pump 32 in which water flows downward, and a single tube plane 38 receiving water from tube plane 36 in which water flows upward before being connected to steam drum 26. It will be understood that the two tube planes 36 and 38 are merely representative of a large number of alternating upward-flowing and downward-flowing tube planes making up the heat-exchange device in economizer 34.

Figure 2:
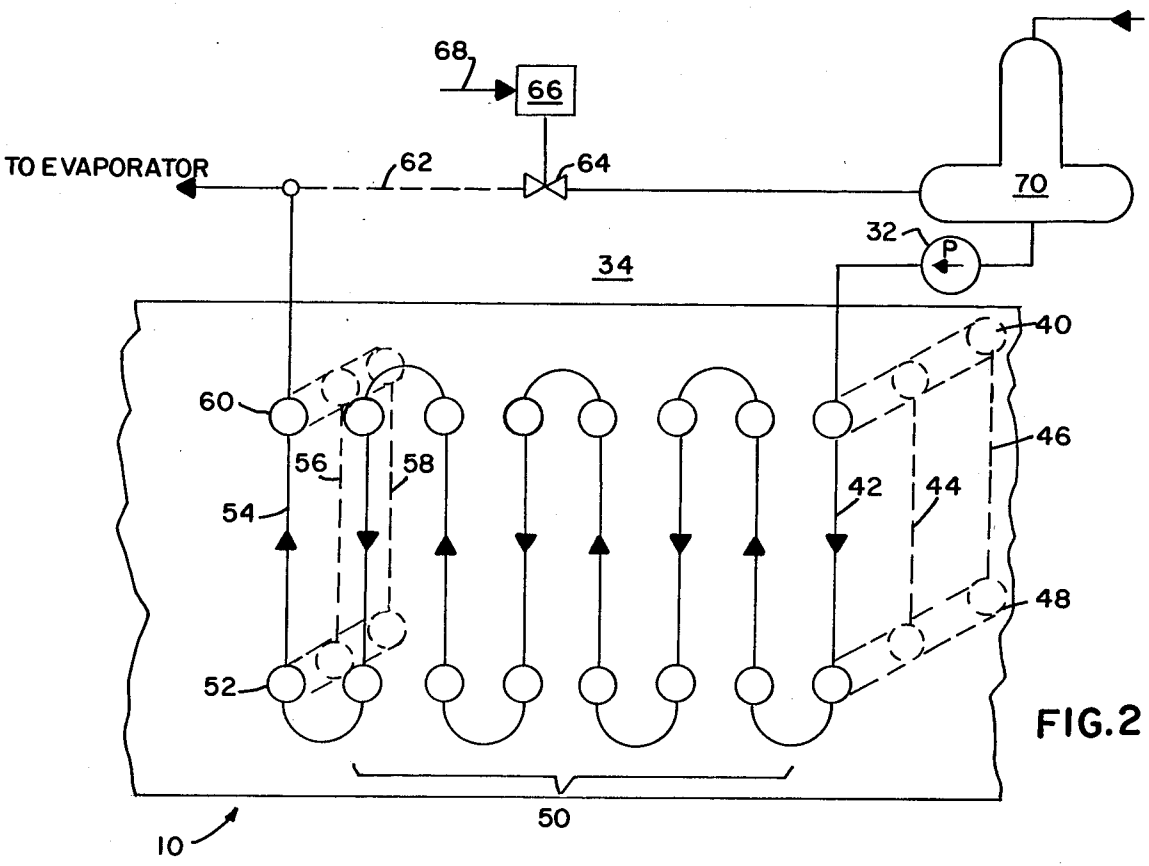
FIG. 2 is a perspective view of a portion of an economizer according to an embodiment of the invention.

Referring now to FIG. 2 a partial view of an interior of economizer 34 according to an embodiment of the present invention is shown with all but representative elements omitted for clarity of presentation. A tube plane 36 is shown receiving feedwater from boiler feed pump 32 at an inlet header 40. The water is forced to flow downward from inlet header 40 through a plurality of parallel tubes, only three of which, 42, 44 and 46, are shown, into a bottom header 48. Although only three tubes 42, 44 and 48 are shown in tube plane 36, a typical tube plane employs as many as, for example, 40 or more parallel tubes. The feedwater in bottom header 48, now having been partially heated during its residence time in tube planes 42, 44 and 46, is applied through a conduit 50 to a bottom header 52 of tube plane 38. The water flows upward through tubes 54, 56 and 58, as representative of the entire array of parallel tubes in tube plane 38, to an outlet header 60.

It is herein assumed that tube plane 36 is the first tube plane receiving feedwater directly from boiler feed pump 32 and that tube plane 38 is the final tube plane discharging heated feedwater to natural circulation evaporator 24. A plurality of intermediate tube planes may be included between tube planes 36 and 38, and they are identified as conduit 50 although it is realized that conduit 50 is really a plurality of connecting serpentine tubes.

As noted in the background section hereof, a problem may occur in the downflowing tubes of economizer 34. The thermodynamic properties of the flow field of heated gas passing a downflowing tube plane may be non-uniform in one or both of the directions transverse to the gas flow. In particular, the flow rate and/or temperature of the gasses flowing past side tubes 42 and 46 may be substantially higher than the gasses flowing past center tube 44 due to sidewall bypassing effects. Additional maldistributions in heat flux from tube to tube may result from small manufacturing tolerances regarding finned tube geometry. Either or both of these effects may tend to make the heat absorbed by some of the tubes in the downflowing tube plane higher than that absorbed by others in the same tube plane. If the temperature and flow conditions of water entering the downflowing tube plane favors it, this difference in absorbed heat may permit buoyancy of water in one or more of the tubes to reduce the water flow rate therein. As a result of the reduced flow rate, the water in the affected tubes experiences a longer residence time in the affected downflowing tubes. The longer residence time permits the absorption of more heat than in the remaining tubes of the downflowing tube plane. The greater heat absorption further adds to the buoyant force. This process can continue until steaming occurs in the affected tube or tubes. The onset of steaming further complicates the problem and may result in a stable reverse flow condition in one or more of tubes 42, 44 or 46 even though a net positive flow is maintained through the downflowing tube plane. If the steaming continues long enough, the interior of the affected tube may dry. Without heat exchange to water within it to limit tube temperature, the temperature of the dried tube or tubes may rise. This can produce thermal fatigue and early tube failure. Actually, steam generation is not a requirement for flow reversal as a multi-valued hydraulic characteristic (pressure drop-flow rate characteristic) can lead to the same end result.

Figure 3:
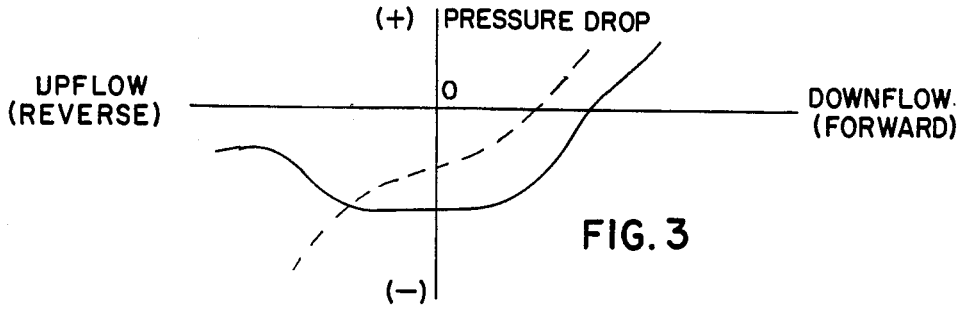
FIG. 3 is a curve to which reference will be made in describing the existence of stable reverse flow at low steam loads.

Referring now to FIG. 3, the cause of flow instability and stable reverse flow in a tube in a downflowing tube plane is illustrated. The net flow in the absence of orificing and recirculation is shown in solid line. It will be noted that, at low flow rates, the flow function has two possible values for a given pressure head. That is, a stable downward (forward) flow or a stable upward (reverse) flow can be obtained over a range of pressure drops. Thus, if a perturbation such as, for example, momentary steaming, shifts the flow from forward to reverse, such reverse flow can continue indefinitely in a stable condition until a greatly increased pressure head is placed across the affected tube.

The result of recirculation is illustrated in dashed line in FIG. 3. In the low-pressure-head region which, in the absence of recirculation, permitted stable values of both forward and reverse flow, recirculation elevates the central drooping flow characteristic sufficiently to make the resulting flow function monotonic. Thus, only a single flow value is possible for any pressure head across a tube. As a consequence, only stable forward (downward) flow is possible in the tube.

A boiler feed pump 32 having the capacity to deliver feedwater at the full load of heat recovery steam generator 10 has a substantial unused pumping capacity at the low load conditions during which steaming and reverse flow may occur in downflowing tube planes of economizer 34. We have further discovered that advantage can be taken of this reserve pumping capacity of boiler feed pump 32 to invoke two phenomena which are effective to overcome the tendency for steaming and reverse flow in downflowing tube planes in economizer 34; that is, increasing the frictional pumping head and reducing the opposing buoyancy force. With reference again to FIG. 2, a recirculation line 62 is connected between outlet header 60 and the inlet of boiler feed pump 32 via a deaerator 70. A valve 64 controls the amount of water being recirculated from outlet header 60 to inlet header 40. A valve actuator 66 may optionally be provided to control the condition of valve 64. In addition, valve actuator 66 may be responsive to a control signal on a control signal line 68 which may originate, for example, in a conventional plant control system.

Figure 4:
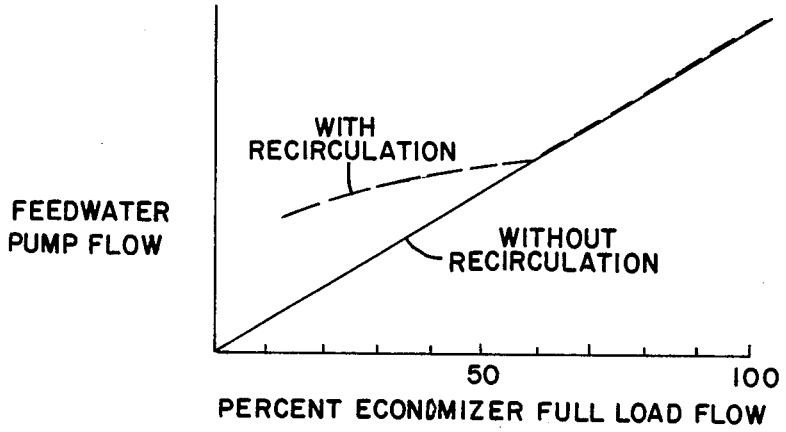
FIG. 4 is a curve showing boiler feed pump flow with, and without, recirculation.
Figure 5:
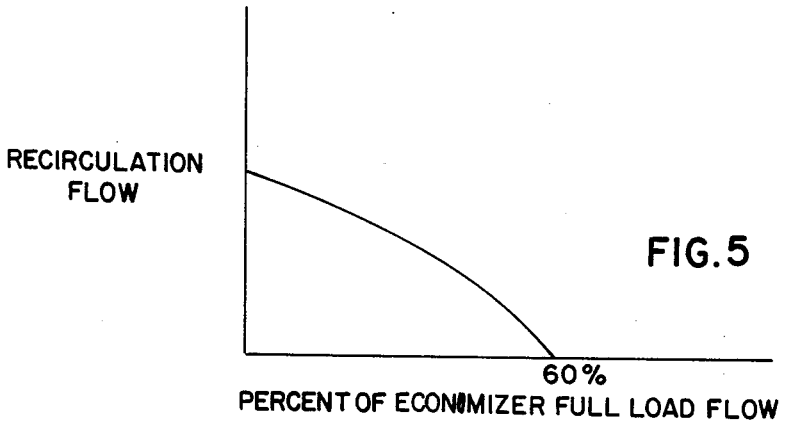
FIG. 5 is a curve relating the amount of feedwater to the steam load of the using process.

Referring now to FIG. 4, the boiler feed pump flow versus economizer full-load flow without using recirculation is illustrated in solid line. The corresponding boiler feed pump flow with recirculation is shown in dashed line. Recirculation flow is added to economizer flow only below about 60 percent of economizer full-load flow to the using process. Above this value, valve 64 is closed. Thus, the total pumping capacity of boiler feed pump 32 is controlled by the full-load flow of economizer 34 and is unaffected by partial recirculation through economizer 34 at loads of less than 60 percent.

Also shown in FIG. 4 is the relationship between the recirculation flow and the percent of full-load flow to the using process. This relationship can be approximated by calculation for any given steam load on heat recovery steam generator 10 (FIG. 1), a corresponding value of recirculation flow is identified. Since the medium in recirculation flow is an incompressible fluid (liquid water), a direct correlation can be provided between a position of valve 64 and the steam load on heat recovery steam generator 10. Thus, if the signal on control line signal 68 is proportional to steam load, a preprogrammed algorithim in valve actuator 66 provides an output signal to control valve 64 to a position which provides the amount of recirculation effective to satisfy the required conditions.

Valve actuator 66 may be implemented in any convenient technology including, for example, digital or analog techniques but, in the preferred embodiment, a digital implementation, and most preferably, a microprocessor implementation, is provided. Since devices for generating the control signal on control line signal 68 and for controlling the position valve 64 in response thereto are well known to one skilled in the art, a further discussion thereof is considered to be redundant and is therefore omitted herefrom.

Referring again to FIG. 2, during startup and low-load operation at which steaming and reverse flow in downflowing tubes may be expected, valve 64 is opened. Since this occurs only when the required feedwater flow to natural circulation evaporator 24 is relatively modest, the total water flow through boiler feed pump 32, consisting of makeup feedwater plus recirculated water, is well within the pumping capacity of a boiler feed pump 32 sized to accommodate the full-load feedwater flow. The additional flow of water through the tube planes of economizer 34 increases the flow rate in individual tubes to a value close to the flow rate at large load. Such increased flow produces an increased pumping head across the headers of each tube plane thereby to reduce the likelihood of initiation of steaming and/or reverse flow. At higher loads above the stability threshold, valve actuator 66 may be closed thereby to direct the full pumping capacity of boiler feed pump 32 to supplying makeup feedwater.

The other phenomenon in operation here tends to reduce the buoyant force of the water as it passes through the tubes of a tube plane. Since the water returned to boiler feed pump 32 by recirculation line 62 has previously made a pass through economizer 34, it has gained a substantial amount of heat. When mixed with makeup feedwater and returned to economizer 34 by boiler feed pump 32, having been passed through deaerator 70, the entering water is hotter than it would be without the recirculation apparatus. Since the water now flowing in the tubes is hotter than it would be without recirculation, the temperature difference between it and the gas flow is reduced. As a consequence, the temperature rise of the water in a pass through a tube plane is reduced. The reduced temperature rise equates to a reduction in the buoyant force opposing the pumping head in downflowing tubes. The reduced buoyant force, in turn, combined with the greater feedwater flow rate, substantially reduces the tendency for the initiation of reverse flow.

The use of the present invention should not be construed to eliminate the possibility of combining the present invention with other techniques to further improve the resistance to reverse flow. For example, recirculation at low load may be combined with tube orificing to further increase the pumping head for additional insurance against reverse flow in downflowing tubes. When orificing is used, however, we have discovered that the addition of recirculation permits the use of much larger orifices for satisfactory operation. For example, in one system of the prior art, orifices as small as 3/16 inch were required to satisfactorily reduce the likelihood of Creverse flow in downflowing tubes. With recirculation as described hereinabove, orifices on the order of from about $\frac{3}{8}$ to about $\frac{5}{8}$ inch may be used at the inlet of the downward flowing economizer tubes having an internal diameter of, for example, about 0.81 inch. Such larger orifices are far more resistant to plugging and offer a much reduced parasitic pumping load than is the case with the smaller orifices necessary without recirculation. Orificing in combination with recirculation may also be attractive for applications where boiler feed pump flow capacity is limiting.

When the reduced full-load pumping pressure loss requirements due to the ability to use larger (or no) orifices with the present invention is taken into account, not only may the pumping requirements not have to be increased to use the present invention, but the full-load feedwater pumping requirements may even be reduced for a net saving in hardware and operating cost.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An economizer system for heating feedwater in a heat recovery steam generator comprising:

at least first and second economizer tube planes;

each of said economizer tube planes including a plurality of generally parallel tubes;

said tubes being generally vertically disposed;

each of said economizer tube planes including a top header and a bottom header;

all of said plurality of tubes in each economizer tube plane being connected in parallel to their top and bottom headers whereby parallel feedwater flow through said plurality of tubes between said top and bottom headers is enabled;

one of said top and bottom headers being an inlet header;

a second of said top and bottom headers being an outlet header;

a boiler feed pump;

said boiler feed pump being effective for applying a flow of feedwater to said inlet header;

means for serially interconnecting said economizer tube planes;

said means for serially interconnecting including means for flowing said feedwater upward and downward in tubes of alternating ones of said economizer tube planes between said inlet header and said outlet header;

means for conveying heated feedwater from said outlet header to a using process;

means for recirculating at least a portion of said heated feedwater from said outlet header to an inlet of said boiler feed pump; and said means for recirculating including means for relating said portion to a steam load in said using process whereby an increased flow is produced through all of said economizer tube planes at values of said steam load below a predetermined value and a condition permitting initiation of reverse flow in any of said tubes is substantially reduced.

2. An economizer system according to claim 1 wherein said means for recirculating includes a recirculation line between said outlet header and said inlet of said boiler feed pump and a valve.

3. An economizer system according to claim 2 wherein said valve includes means responsive to a control signal for opening said valve when an amount of said heated feedwater being fed to said using process is less than a predetermined value and for closing said valve when said amount exceeds said predetermined value.

4. An economizer system according to claim 3 wherein said predetermined value is a value effective to prevent initiation of reverse flow in said tubes.

5. An economizer according to claim 1, further comprising an orifice in at least some of said tubes, said orifice being effective to increase a pressure head in said at least some of said tubes whereby an initiation of reverse flow in said tubes is prevented.

6. A method for reducing reverse flow in vertical tubes of an economizer of a heat recovery steam generator, wherein said economizer includes at least first and second substantially vertical economizer tube planes each having a top and bottom header and a plurality of parallel tubes connected between said top and bottom header for permitting parallel feedwater flow therein, said economizer including a boiler feed pump feeding a flow of makeup feedwater to an inlet header of one of said first and second economizer tube planes, comprising:

serially interconnecting said economizer tube planes for flowing said feedwater upward and downward in tubes of alternating ones of said economizer tube planes between said inlet header and an outlet header;

feeding heated feedwater from said outlet header to a using process; and recirculating at least a portion of said heated feedwater from said outlet header to an inlet of said boiler feed pump whereby an increased flow is produced through all of said economizer tube planes and a condition permitting initiation of reverse flow in any of said tubes is substantially reduced.

7. A method according to claim 6 wherein the step of recirculating at least a portion of said feedwater includes recirculating a substantial portion of said feedwater when an amount of said heated feedwater fed to said using process is less than a predetermined value and stopping said recirculating when said amount is greater than said predetermined value.

8. A method according to claim 6 further comprising orificing at least some of said tubes.

* * * * *